United States Patent [19]

Willenbacher

[11] Patent Number: 4,681,048

[45] Date of Patent: Jul. 21, 1987

[54] SEWING MACHINE AND METHOD FOR CONTROLLING THE MOTION OF A WORKHOLDER

[75] Inventor: Erich Willenbacher, Kaiserslautern, Fed. Rep. of Germany

[73] Assignee: Pfaff Industriemaschinen GmbH, Fed. Rep. of Germany

[21] Appl. No.: 839,359

[22] Filed: Mar. 13, 1986

[30] Foreign Application Priority Data

Mar. 16, 1985 [DE] Fed. Rep. of Germany ..... 3509526

[51] Int. Cl.[4] ..... D05B 21/00; D05B 27/22

[52] U.S. Cl. ..... 112/262.3; 112/121.12; 112/315

[58] Field of Search ..... 112/121.11, 121.12, 112/121.15, 275, 262.1, 272, 2, 102, 103, 315, 314, 262.3

[56] References Cited

U.S. PATENT DOCUMENTS

| | | | |
|---|---|---|---|
| 3,385,245 | 5/1968 | Ramsey et al. | 112/102 |
| 4,069,778 | 1/1978 | Kozawa | 112/121.12 |
| 4,495,877 | 1/1985 | Willenbacher | 112/275 X |
| 4,498,404 | 2/1985 | Sadeh | 112/121.12 |
| 4,513,677 | 4/1985 | Scholl | 112/121.12 X |
| 4,526,114 | 7/1985 | Martell et al. | 112/275 X |
| 4,583,476 | 4/1986 | Fischer | 112/275 |
| 4,610,210 | 9/1986 | Kinoshita et al. | 112/262.3 X |

*Primary Examiner*—Peter Nerbun

*Attorney, Agent, or Firm*—McGlew and Tuttle

[57] ABSTRACT

Sewing machine with a control for the movement of a workholder. For the formation of edge parallel seams when sewing on labels with seam sections extending parallel to the movement axes of a cross slide system carrying the work holder, there are arranged at uniform distance from the stitch hole four transmitted light sensors, of which always only the one which can recognize the crosswise extending following edge of a seam section is switchable into readiness for operation. After a signal has been given by a sensor, the respective drive motor of the cross slide system is controlled by means of a microcomputer in such a way that the respective seam section ends exactly in the intended corner. Because of the work related feed control, a sewing program is not needed. Besides, the control automatically adapts itself to different label dimensions.

8 Claims, 3 Drawing Figures

Fig. 1
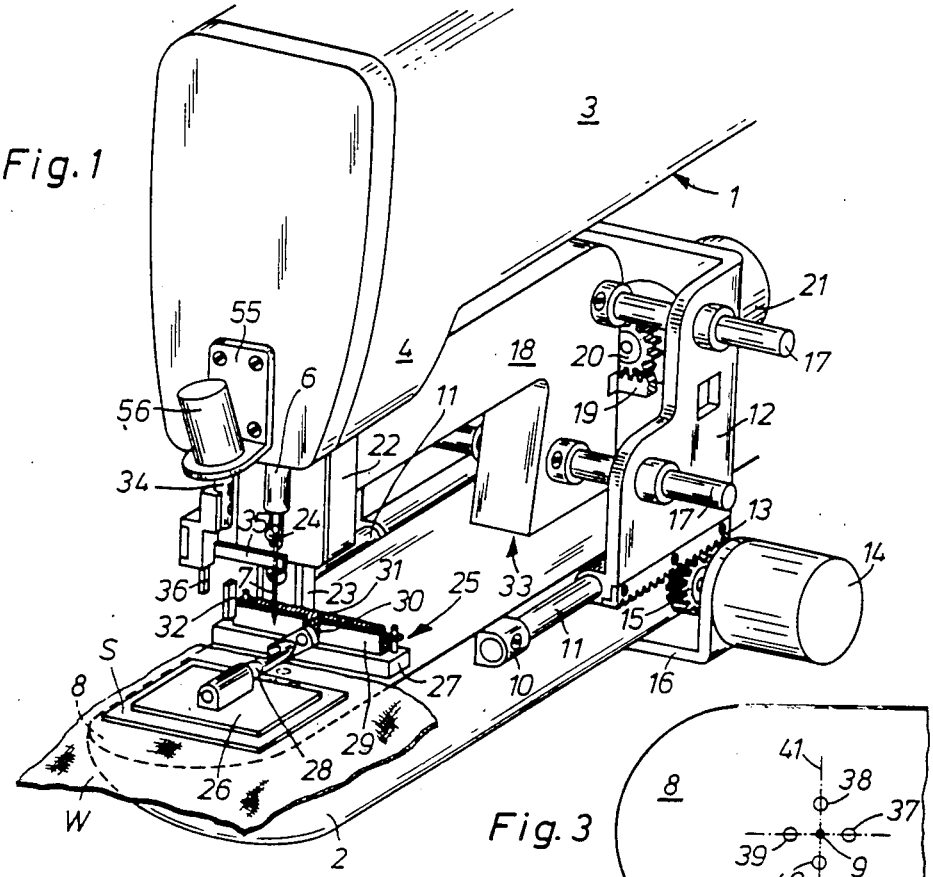
Fig. 3
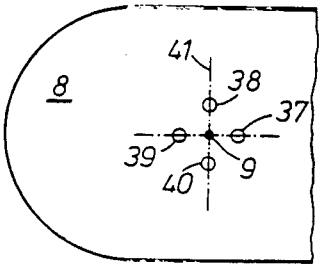
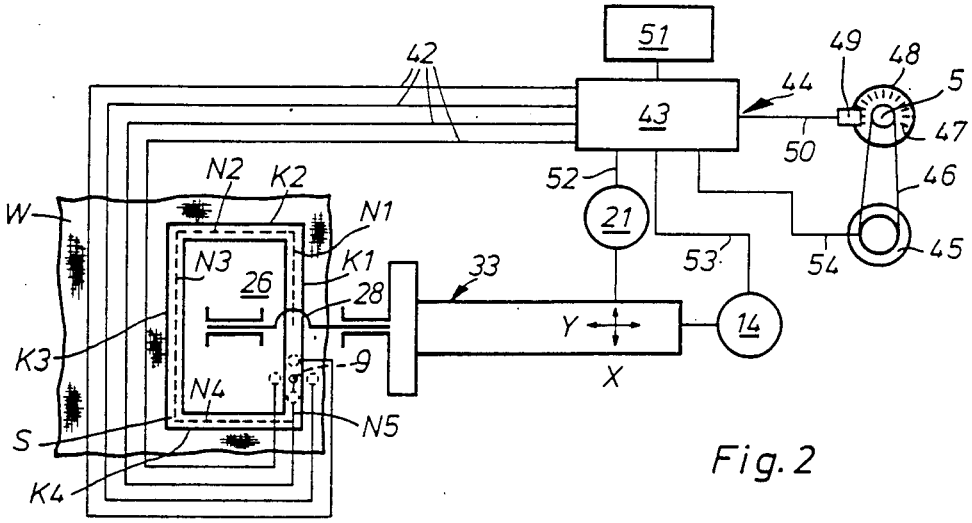
Fig. 2

SEWING MACHINE AND METHOD FOR CONTROLLING THE MOTION OF A WORKHOLDER

FIELD AND BACKGROUND OF THE INVENTION

This invention refers to sewing machines and in particular to a new and useful control for a sewing machine for the motion of a workholder.

From U.S. Pat. No. 4,444,734 a sewing machine with a cross slide guide workholder driven by two step motors is known. The motors are operated by a control unit which comprises, among other things, a microcomputer. By X-and Y-axis scale switches the basic seam program contained in the memory can be varied in X and/or Y direction. This type of seam size variation can be carried out relatively easily and quickly. However, if this sewing machine is used for sewing cloth parts, e.g. labels, on a workpiece, it would take too much time, despite the easy variability, to make a size adaptation for every cloth part that differs in size from the cloth part sewn on before, so as to obtain a uniform seam distance at all edges. Besides, in this case the cloth part must be exactly centered in the workholder, because otherwise the seam would be shifted relative to the edges of the cloth part and thus irregular seam distances would occur.

U.S. Pat. No. 4,073,247 discloses a sewing machine with a cross slide guided workholder for the edge parallel sewing of workpieces. The sewing machine comprises a work edge scanner with light source disposed below the workpiece and a camera disposed above the workpiece. The camera contains a linear arrangement of a plurality of photo diodes and can be rotated through a positioning drive about a vertical axis in X and Y directions of the cross slide system of the workholder, the diode row being aligned substantially crosswise to the work edge to be scanned. The photodiodes illuminated during the scanning process emit a proportional number of pulses which, depending on the rotational position of the camera, are supplied to a corresponding input of a signal processing system containing a microcomputer. As soon as the previously scanned workpiece is in the working position, the signal processing system calculates from the signals received from the camera and from additionally entered sewing parameters the control commands for the drive motors of the cross slide system. As this sewing machine does not operate with a given basic seam program but automatically determines for each workpiece the specific control data for the forward movement of the workholder, it is suitable in particular for the treatment of workpieces which successively differ in size and/or form. This advantage, however, is offset by a considerable technical effort.

SUMMARY OF THE INVENTION

The invention provides a sewing machine for the sewing on of cloth parts, e.g. labels, on a workpiece by means of a seam consisting of seam sections determined as to direction, where the cloth part is scanned directly during the sewing for the formation of control commands for the motors.

By the measure of arranging one sensor spaced from the stitch hole for each movement direction of the workholder that occurs during a sewing cycle in order to recognize the cloth part edge extending substantially crosswise to the respective sewing direction, and switching into readiness for operation by the control system always only the sensor which precedes the stitch hole in a forward direction of the workholder, there is scanned for each individual seam section the cloth part edge extending substantially crosswise and determining the end of this seam section. Based on the sensor signal and in consideration of the size of the seam distance entered in a memory of the control unit and in consideration of the preselected stitch length, the microcomputer of the control unit now calculates the number of residual stitches still required before the seam corner is reached.

If it is found in the calculation that the last of the residual stitches still to be formed would not coincide with the desired seam corner, depending on whether the last residual stitch would go beyond the desired seam corner, with a smaller or with a larger distance, the stitch length of the residual stitches still to be sewn after the sensor signal is reduced or respectively, omitting one stitch, increased to such an extent that the last residual stitch lies exactly in the desired seam corner. Being that the stitch/length correction value is divided over several residual stitches, the length of the residual stitches sewn after the sensor signal differs very little from that of the previously formed residual stitches, so that all in all a very uniform seam pattern is obtained.

As the seam corner is reached, the motor that was in operation until then is stopped and the motor needed for the formation of the next seam section is started, whereupon this seam section is formed without interruption to the next seam corner. This second seam corner as well as all further seam corners are approached equally exactly in the same manner by means of the respective sensors.

Since the motors are controlled only by the given parameters of seam distance and stitch length and also by the sensor signals generated with the scanning of the respective cloth part edges; and since therefore they do not require a sewing program containing the geometric data of the seam, the control commands for the motors serving for the forward movement of the workholder are derived directly from the cloth piece to be sewn on, so that the seam is always formed matching the respective cloth part, and even in case of a cloth part arranged out of center in the work-holder, equal seam distances are obtained all around.

An especially simple construction of the sewing machine results if on it only seams with seam sections extending parallel to the cross slide axes are to be formed and for the formation of seals with seam sections extending parallel to the cross slide axes there are arranged in the stitch plate four transmitted light sensors to which at equal distance from the stitch hole, lie on a system of coordinates aligned with the cross slide axes and centered on the stitch hole.

The sewing machine according to the invention can be used advantageously also for the formation of seams where one or more seam sections extend at an angle of, e.g. 45°, to the other seam sections. In this case, both motors of the cross slide systems are operated simultaneously for the formation of the angularly extending seam sections, and the cloth part edges are scanned simultaneously possibly by two adjacent sensors.

Accordingly it is an object of the invention to provide an improved sewing machine construction in which the workpiece is advanced in respect to a reciprocating needle of the machine in accordance with signals from a plurality of sensors which advantageously include a single sensor located along each axis at which a seam is to be formed.

A further object of the invention is to provide a control system for moving a workpiece in association with a needle of a sewing machine which includes a microcomputer which is operated in consideration of a sensor located so as to recognize the starting edge of a piece to be sewn and to indicate the approach of a corner at which a following seam is to be formed and to control the movement of the needle in respect thereto so that the seams being sewn terminate at the precise edge at which they are intended to which further includes means for sensing before the edge is approached the number of stitches that would be required to terminate the stitch at the corner location.

A further object of the invention is to provide a sewing machine which is simple in design, rugged in construction and economical to manufacture.

A further object of the invention is to provide a method of effecting sewing of a seam which is to be directed along at least two seam lines which are arranged along axes which are at an angle to each other and which comprises using a sensor to locate the edge of an object to be sewn so that the needle will begin an initial seam, advancing the workpiece in respect to the needle to form the initial seam but before it is finished, sensing where the next seam is to begin and forming the remaining first seam with a required spacing of stitches to bring the end of the stitch formation to the corner at which the second seam is to be begun.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a front top perspective view of a part of a sewing machine constructed in accordance with the invention;

FIG. 2 is a block diagram of the control unit for the sewing machine of FIG. 1; and FIG. 3 is a top view onto the stitch plate of the sewing machine of FIG. 1.

DESCRIPTION OF THE PREFERRED EMBODIMENTS

Referring to the drawings in particular, the invention embodied therein comprises a sewing machine generally designated 1 which has a stitch plate 8 carrying a plurality of sensors 37,38,39 and 40 which are advantageously located in a spaced location from a stitch hole 9 through which a needle guiding the thread 7 is moved and along each axes of which a seam is to be formed. In the embodiment of the invention shown, the seam is to be formed along five separate stitch lines or seam lines N1 to N5. To effect the shifting of the workpiece W and a cloth part S which is to be affixed to the workpiece by a seam formation, the embodiment of the invention shown provides for the formation of the five stitch lines to secure the cloth part 5 to the workpiece 8.

The sewing machine comprises a housing 1, of which a support arm 2 and an arm 3 with a head 4 is illustrated. Mounted in arm 3 is an arm shaft 5, shown only symbolically in FIG. 2, which drives a needle bar 6 upwardly and downwardly. Secured in the needle bar 6 is a thread guiding needle 7 which cooperates with a shuttle (not shown) for the formation of stitches. The shuttle is located below a stitch plate 8 which is arranged in the support arm 2 and has a stitch hole 9 for the passage of the needle 7.

A guide bar 11 is arranged on both sides of the support arm 2 and is parallel to the longitudinal axis of the support arm. On the guide bars 11, a U-shaped slide 12 spanning the support arm 2 is mounted, on which a rack 13 is secured. Meshing with rack 13 is a pinion 15 driven by a step motor 14. The step motor 14 is disposed at a bracket 16 secured to the housing 1.

On two guide bars 17 sliding in slide 12 and extending crosswise to the longitudinal axis of support arm 2, a substantially U-shaped yoke 18 is fastened. Yoke 18 carries a rack 19 which meshes with a pinion 20. Pinion 20 is driven by a step motor 21 secured on the slide 12. At the free end of the yoke 18, a guide head 22 is disposed, in which a carrier 23 displaceable in vertical direction is received. The carrier 23 is pushed downward by a spring (not shown) arranged inside the guide head 22, and now comprises a cross pin 24 protruding through a slit in the guide head 22.

Arranged on carrier 23 is a holding mechanism 25 known from German Pat. No. 1,115,113 for a pressure plate 26. The holding mechanism 25 consists essentially of an intermediate piece 27 fastened to the carrier 23, a U-shaped crank 28 rotatably mounted in said intermediate piece, and a spring loaded slide block 29 movable relative thereto. A pin 30 fastened to crank 28 engages in a cutout 31 on slide block 29. An upwardly extending lug 32 is fastened on slide block 29. The structural elements 11 to 32 form a workholder 33 for the work W and a cloth part S to be sewn onto it, the movement directions of the slide 12 and of the yoke 18 constituting the Y axis and the X axis of a cross slide system.

In head 4, a lift bar 34 is arranged which is liftable by a drive mechanism not shown. Secured on the lift bar 34 are a finger 35 protruding crosswise and a stop 36 protruding downward and cooperating with lug 32.

Fastened in the stitch plate 8 at equal distance to the stitch hole 9 are four transmitted light sensors 37, 38, 39, 40 which lie with their upper end and the top side of the stitch plate 8 in a common plane. The sensors 37, 38, 39, 40 lie on a system of coordinates 41, the two axes of which are aligned with the X- and Y-axes of the cross slide system. The sensors 37, 38, 39, 40 are connected via line 42 to corresponding inputs of a microcomputer 43, which is a component part of a control unit 44 for the step motors 14 and 21 as well as for a motor 45 shown symbolically in FIG. 2. The motor 45 is in drive connection with the arm shaft 5 via a belt drive 46 and serves to drive the sewing machine.

On the arm shaft 5 a strobe disc 48 provided with a plurality of bar marks 46 is fastened; it cooperates with a pulse generator 49. Pulse generator 49 is connected via a line 50 to one input of the microcomputer 43.

To another input of microcomputer 43 an input device 51 is connected. The two step motors 14, 21 are connected via lines 52, 53 and control circuits (not shown) to two outputs of the microcomputer 43. Another output of microcomputer 43 is connected via a line 54 to the control circuit (not shown) of motor 45.

Secured on a bracket 55 disposed at heat 4 is a lighting fixture 56 which illuminates the area of the sensors 37, 38, 39, 40.

The sewing machine operates as follows:

For placing a workpiece W and a cloth part S to be sewn thereon on the support arm 2, the lift bar 34 is raised. The lift bar 34 engages by its finger 35 under the pin 24 and in so doing lifts the carrier 23 and the holding mechanism 25 together with the pressure plate 26. The workpiece W is then positioned on the support arm 2 and the cloth part S is aligned under the pressure plate 26. It suffices for the cloth part S to be aligned parallel to the edge. It need not be centered under the pressure plate 26 at the same time, whereby the aligning process is substantially simplified. Then the pressure plate 26 is lowered, whereupon it seizes the cloth part S and the workpiece W by frictional contact. The pressure plate 26 and crank 28 are then in the position shown in FIG. 1.

Since in a non centered position of the cloth part S its edge K1 can have any distance from the stitch hole 9, provision must be made before sewing is begun that the edge K1 has a distance from the stitch hole 9 which corresponds to the intended seam distance. For this purpose the workholder 33 is first moved to the left by the step motor 14 according to FIG. 2 until the sensor 38 recognizes the edge K1. Thereafter the step motor 14 moves the workholder 33 to the right again, the microcomputer 43 controlling the number of steps of the step motor 14 and hence the displacement path of the workholder 33 as a function of the value of the seam distance entered via the input device 51, in such a way that thereafter edge K1 is at the intended seam distance from the stitch hole 9.

The sewing cycle is started with the motor 45 being turned on, whereupon the first stitch of the seam section N1 is formed in the region of the crank throw below the pivot axis of crank 28. After formation of the first stitch, step motor 21 displaces the workholder 33 by the amount of the stitch length set at the input device 51. The timing of the forward movement is controlled by means of the pulses generated by the pulse generator 49 as a function of the position of the arm shaft 5 in such a way that the workholder 33 is displaced always only during the time that the needle 7 is above the cloth part S. During formation of the seam section N1, only the sensor 38 nearest the edge K2 subsequently to be worked, that is, the one preceding the stitch hole 9 parallel to the forward direction of the work holder 33 is switched by computer 43 into readiness for operation.

As soon as sensor 38 has recognized the edge K2 of cloth part S through the workpiece W, microcomputer 43 calculates, on the basis of the sensor signal as well as the size of the set stitch length and of the seam distance from the edges K1 to K4 of the cloth part S, the number of residual stitches still required before the seam corner lying at seam distance from the edge K2 is reached. If it is established in the calculation that the last of the residual stitches still to be formed would not coincide with the desired seam corner, the stitch length of the residual stitches still to be sewn after the sensor signal is decreased or, omitting one residual stitch, increased, depending on whether the last residual stitch would go beyond the desired seam corner with a smaller or larger distance, to such an extent that the last residual stitch lies exactly in the desired seam corner. Being that the stitch length correction value can be distributed over several residual stitches, the stitch length of the residual stitches sewn after the sensor signal differs very little from the stitch length of the previously formed stitches, so that all in all a very uniform seam pattern is obtained.

After the seam corner has been reached, the microcomputer 43 causes the step motor 21 to stand still and the step motor 14 to be actuated instead for the formation of the seam section N2. At the same time the sensor 38 is disconnected and sensor 39 switched to readiness for operation. Approach of the seam corner of seam section N2 and of the remaining seam sections N3 and N4 occurs in the same manner as described above for seam section N1.

In the formation of seam section N5, the lug 32 strikes against the stop 36 protruding into its movement path, whereby the slide block 29 is retained, which until then had been moving jointly with the intermediate piece 27. By the then occurring relative movement between the intermediate piece 27 and the slide block 29, crank 28 is pivoted into the position shown in FIG. 2.

The end point of seam section N5 does not coincide with a seam corner but lies at the point of the first stitch of seam section N1, seam section N5 having the same length as the seam section N1. Since in this case none of the sensors 37 to 40 can be used for the approach of the end point of seam section N5, previously the number of steps to be executed by step motor 21 required for the production of seam section N1 is totaled and later step motor 21 is controlled by means of the stored value in the formation of seam section N5. In this manner the last stitch of seam section N5 is formed in the place of the first stitch of seam section N1, with the stitch formation again occurring in the region of the crank throw below the pivot axis of crank 28.

While specific embodiments of the invention have been shown and described in detail to illustrate the application of the principles of the invention, it will be understood that the invention may be embodied otherwise without departing from such principles.

What is claimed is:

1. A sewing maching comprising a stitch plate with a stitch hole, a cross slide mounted on the sewing machine for movement along two axes which are at angles from each other, a workholder carried by and guided by said cross slide, first and second drive motors driving said slide along the respective axes, a control unit with a microcomputer connected to said motors for the formation of an edge parallel seam on a cloth part received in the workholder, sensor means for recognizing the next following cloth part edge extending at an angle to the particular transport direction of said workholder with respect to each transport direction of said workholder occurring during a sewing cycle, said sensor means including a sensor for each seam to be sewn located at spaced locations from the stitch hole, said control unit being operable so that always only the sensor preceding the stitch hole in the direction of advance of the workholder can be switched to readiness for operation, and that for approaching the seam corners said first and second motors being controllable by said control unit upon formation of at least one residual stitch by the signal of a respective sensor as well as in dependence upon a selected stitch length and the distance of the seam from the cloth part edge.

2. A sewing machine according to claim 1, wherein for the formation of seams with seam sections extending parallel to the cross slide axes there are arranged in said stitch plate four transmitted light sensors located in spaced relationship to the stitch hole and lying on a system of coordinates aligned with the cross axes and centered on the stitch hole.

3. A method of effecting the sewing of a seam with a needle sewing into a stitch hole which seam is to be directed along at least two seam lines which are arranged along axes which are at an angle to each other, comprising using a first sensor to locate the edge of the workpiece to be sewn and, in response to the location sensed positioning a workholder in respect to the needle so that the needle will be positioned to begin an initial seam, starting the needle while advancing the workpiece in respect to the needle to form a first seam but before the first seam is finished, sensing where a second seam is to begin and forming the remaining first seam with a required spacing of stitches to bring the end of the stitch formation to the corner at which the second seam is to be begun, and including locating the first sensor to locate an edge of the seam area, beginning the sewing by sewing through the stitch hole which is located by the first sensor and wherein a computer is used to program the entire seam formation which has an input for determining seam spacing, and wherein a secondary sensor is provided, at the location of the second of the formed seams after the first seam which senses the location at which the second of the formed seams will end on the second formed seam and revises the speed of the sewing machine so that the stitch will end at the end of the second seam.

4. A method according to claim 3, wherein the workpiece is moved in at least two axial directions by a separate stepping motor driving a yoke which has a workpiece engagement plate.

5. A method according to claim 3, wherein said computer has a separate input for varying the seam lengths and wherein said sewing machine has shaft with a pulse generator generating pulses which are delivered to said computer as an indication of the speed thereof and a control from the computer to the driving motor for the shaft of the sewing machine.

6. In a sewing machine for securing a seam along a plurality of seam lines and having an area stitch plate with a stitch hole provided to receive the passage of a reciprocating needle which is driven by a rotating main shaft, the improvement comprising a yoke having a head portion mounted on the sewing machine for movement in two directions, a carrier movably mounted on said yoke upwardly and downwardly in said head portion, an attachment presser plate carried by said carrier engageable over a workpiece within a seam forming area, and being engageable with the workpiece to move it relative to the needle with said yoke, a first drive connected to said yoke to move it along a first axis, a second drive connected to said yoke to move it along a second axis at an angle to said first axis, a sensor located along each axis at a spaced location from the stitch hole and at locations adjacent each seam line to be sewn successively after a first seam line, and control means connected to said sensors and operable in timed relationship to the speed of operation of the main shaft and connected to said first and second drives and effective to actuate said sensors to be effective to recognize an edge of the workpiece, locate the stitch hole distance from the edge to start the drive of the sewing machine to form the first stitch, and to displace the workpiece by starting said first drive to move said yoke along a first axis to form the first stitch, only one of said sensors being effective as the motor of the sewing machine drives the sewing needle to form the first seam to measure the operating strokes of the needle to make changes in the stitch formation when the needle is above the cloth and to recognize the location of the seam and the amount that the seam will have to be varied in stitch length to ensure that the first seam line coincides with the intersection of the second seam line to be sewn, said control means including a computer having an input which may vary the setting of the length of each seam.

7. In a sewing machine according to claim 6, wherein said computer is connected to the sewing machine drive, said first and second drives and when the first seam has reached its predetermined length it stops the first drive motor driving said yoke and starts said second drive motor to move said yoke along a second axis and to begin the formation of a second stitch.

8. In a sewing machine according to claim 6, wherein said computer measures the length of the first seam that is to be formed and in cases where the stitches to enclose an area and return back to the initial position of the needle, the computer uses this information to form a length of stitch in the last stitch line to be formed which will bring it back to the original position.

* * * * *